US007574825B2

(12) United States Patent
Lacorte

(10) Patent No.: US 7,574,825 B2
(45) Date of Patent: Aug. 18, 2009

(54) GUN SIGHT WITH CONTINUOUSLY MEASURING RANGEFINDER

(75) Inventor: Jon B. Lacorte, East Northport, NY (US)

(73) Assignee: Nikon Inc., Melville, NY (US)

( * ) Notice: Subject to any disclaimer, the term of this patent is extended or adjusted under 35 U.S.C. 154(b) by 284 days.

(21) Appl. No.: 11/345,227

(22) Filed: Feb. 2, 2006

(65) Prior Publication Data

US 2007/0175081 A1 Aug. 2, 2007

(51) Int. Cl.
*F41G 1/00* (2006.01)

(52) U.S. Cl. ..... 42/142; 42/122; 89/41.06; 89/41.17

(58) Field of Classification Search ..... 42/122, 42/130, 142, 119, 114; 89/41.06, 41.17
See application file for complete search history.

(56) References Cited

U.S. PATENT DOCUMENTS 3,682,552 A * 8/1972 Hartman ..... 356/3
3,865,491 A * 2/1975 Hogan ..... 356/139.06
4,948,973 A 8/1990 Comeyne
4,949,089 A 8/1990 Ruszkowski, Jr.
5,026,158 A * 6/1991 Golubic ..... 356/252
5,194,908 A 3/1993 Lougheed et al.
5,686,690 A 11/1997 Lougheed et al.
5,771,623 A 6/1998 Pernstich et al.
6,311,424 B1 11/2001 Burke
6,357,158 B1 3/2002 Smith, III
6,871,439 B1 3/2005 Edwards
2002/0197584 A1* 12/2002 Kendir et al. ..... 434/21
2003/0174315 A1* 9/2003 Byren et al. ..... 356/152.1
2005/0195385 A1* 9/2005 Holmberg ..... 356/8
2005/0241209 A1 11/2005 Staley, III
2005/0246910 A1 11/2005 Mowers
2006/0010760 A1* 1/2006 Perkins et al. ..... 42/142
2007/0137090 A1* 6/2007 Conescu ..... 42/142
2007/0157502 A1* 7/2007 Holmberg ..... 42/124

* cited by examiner

*Primary Examiner*—Troy Chambers
(74) *Attorney, Agent, or Firm*—Oliff & Berridge, PLC

(57) ABSTRACT

A gun sight includes a rangefinder that operates in a continuous-measuring mode as soon as the rangefinder is activated. Because the rangefinder is continuously determining the distance to the target when in the continuous-measuring mode, the user does not have to take any time to press any buttons in order to obtain a distance measurement to a sighted target while aiming at that target.

20 Claims, 3 Drawing Sheets

GUN SIGHT WITH CONTINUOUSLY MEASURING RANGEFINDER

BACKGROUND

The invention relates to gun sites having rangefinders, particularly for use with rifles.

It is known to provide gun sights, particularly telescopic gun sights, with a rangefinder that measures the distance from the gun sight to a target within the cross hairs of the gun sight. One example of such a telescopic gun sight is shown in U.S. Pat. No. 5,771,623. The user presses a button on the side of the telescopic sight in order to turn on the rangefinder. At this point in time, the rangefinder does not attempt to take any measurements. The user then sights the target by placing the target in the cross hairs of a reticle of the telescopic sight. The user then presses the button a second time to cause the rangefinder to emit a laser beam toward the target and thus determine the distance to the target. The user is informed of the distance, and then the user can appropriately aim at the target while taking into account any bullet drop that may occur due to the distance to the target. Some rangefinders also have a continuous-measuring mode in which, after the rangefinder has been turned on (for example, by pressing a button once), the user can then hold down the button so that the rangefinder continuously emits a laser beam and thus continuously measures the distance from the telescopic sight to the object positioned in the cross hairs of the reticle.

A problem with presently available sights having rangefinders is that the user must press a button to cause the rangefinder to take a measurement while the user is pointing the gun on which the rangefinder is mounted at the target so that the target is in the cross hairs of the sight. Pressing the button while aiming at a target can be awkward and can cause the gun to move, which obviously adversely affects the accuracy of the shot. Pressing the button after aiming also takes a certain amount of time, and thus causes a delay in taking a shot at the target, which can cause the user to miss an opportunity at a good shot.

SUMMARY

According to aspects of the invention, a gun sight includes a rangefinder that operates in a continuous-measuring mode as soon as the rangefinder is activated. Because the rangefinder is continuously determining the distance to the target when in the continuous-measuring mode, the user does not have to take any time to press any buttons in order to obtain a distance measurement to a sighted target while aiming at that target.

According to one embodiment, the gun sight includes the rangefinder and a reticle through which a target is viewed. The rangefinder includes a transmitter and a receiver. The transmitter emits energy toward the target, and the receiver receives energy reflected by the target. The rangefinder determines a distance to the target from the energy received by the receiver. In one preferred embodiment, the rangefinder is a laser rangefinder having a laser transmitter and a laser receiver that receives laser light reflected by the target.

According to one embodiment, the rangefinder includes a default mode setting switch that enables a user to selectively place the rangefinder in either the continuous-measuring mode or a user-specified measuring mode as a default mode in which the rangefinder automatically operates when the rangefinder is activated (turned on).

According to another embodiment, the rangefinder includes a mode-override switch that enables a user to place the rangefinder into a user-specified-measuring mode instead of the continuous-measuring mode.

The rangefinder indicates the measured distance to the target. For example, the rangefinder can include a display that displays the measured distance to the target for viewing by a user of the gun sight. The display can display the measured distance on the reticle of the gun sight. According to another embodiment, the rangefinder indicates the measured distance to the target by identifying a sighting area of the reticle that should be used to aim at the target.

BRIEF DESCRIPTION OF THE DRAWINGS

The invention will be described in conjunction with the accompanying drawings of exemplary embodiments in which like reference numerals designate like elements, and in which.

DETAILED DESCRIPTION OF EMBODIMENTS

Figure 1:
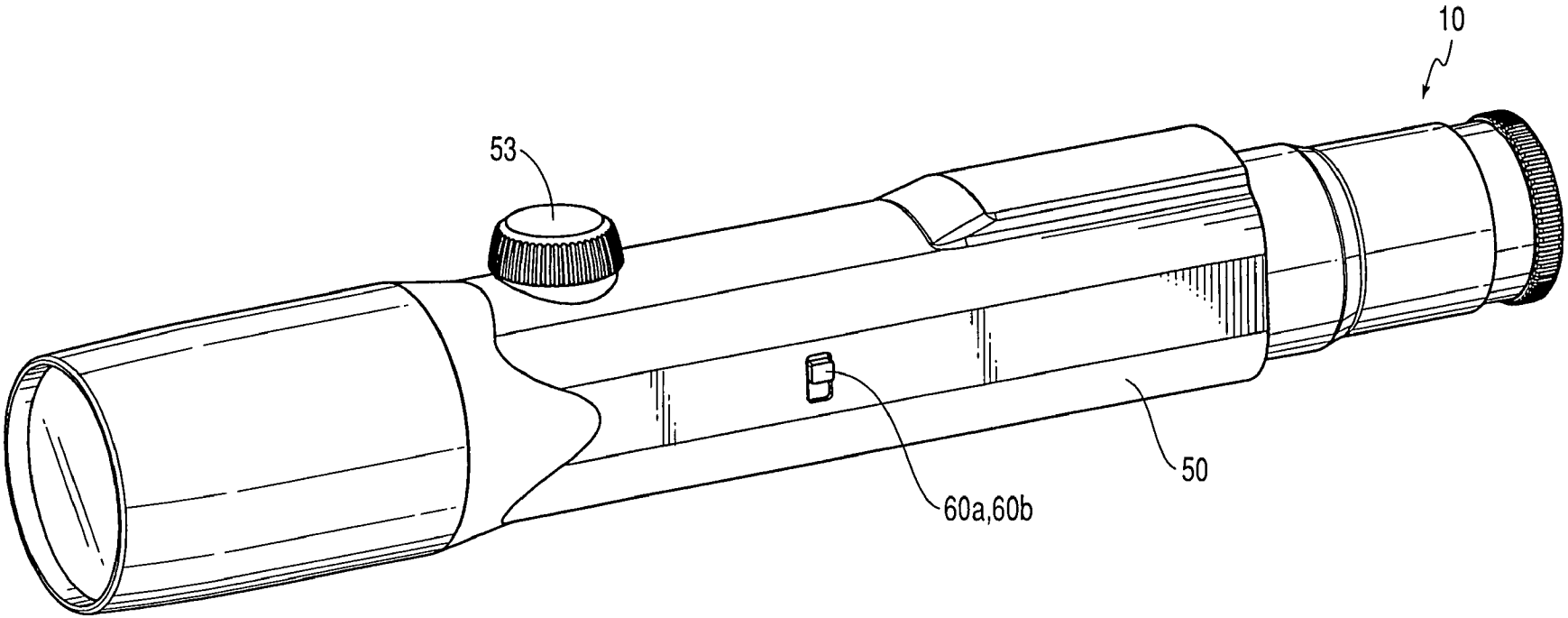
FIG. 1 is a perspective view of a telescopic sight according to an embodiment of the invention.

FIG. 1 is a perspective view of a telescopic gun sight 10 to which aspects of the invention can be applied. The manner in which the telescopic gun sight functions, including the particular optical arrangement used, and the manner in which its rangefinder determines the distance to object, can vary and are not critical aspects of the invention. Thus, the particular optical and other structure of the telescopic gun sight including the rangefinder are not described herein in detail. One example of a telescopic gun sight and rangefinder to which aspects of the invention can be applied is described in the above-mentioned U.S. Pat. No. 5,771,623, the disclosure of which is incorporated herein by reference in its entirety. The telescopic gun sight of U.S. Pat. No. 5,771,623 measures the distance to a target sighted in the center cross hairs of the scope's reticle (that is, the optical system for the rangefinder and for the gun sight are integrated). The rangefinder determines the distance to the target based upon the time required for an emitted light beam to travel from the rangefinder to the target and then back to the rangefinder. The invention, however, can be applied to gun sight/rangefinder systems different from what is shown in U.S. Pat. No. 5,771,623.

The gun sight (or scope) 10 includes an integral rangefinder 50, a mode selection switch 60*a* or 60*b*, to be described below, and one or more adjustment knobs 53 for use in adjusting the aiming point of the scope 10 after the scope has been mounted to a gun such as a rifle. For example, after mounting the scope 10 to a rifle, the one or more adjusting knobs 53 are adjusted so that the center cross hairs of the gun sight correspond to a target that will be struck by the projectile shot by the rifle at a known range (for example, 200 yards).

Figure 2:
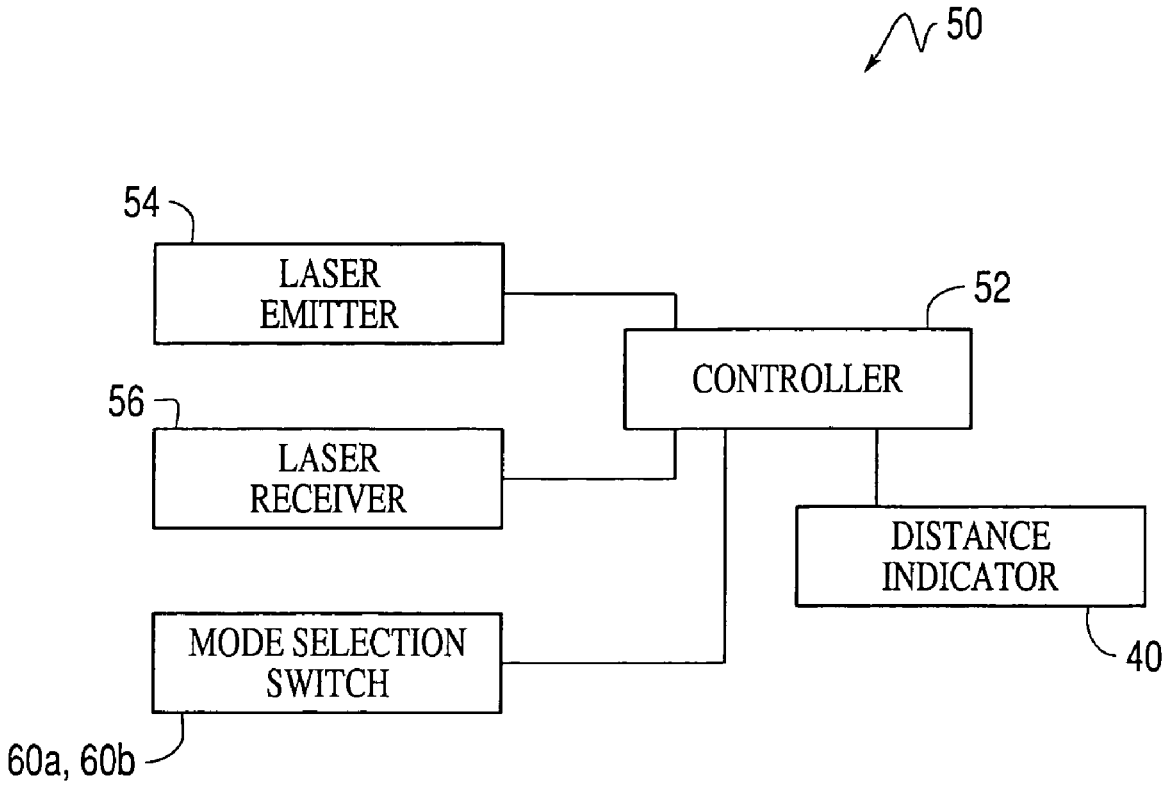
FIG. 2 is a block diagram showing components of a telescopic sight incorporating a rangefinder according to an embodiment of the invention.

FIG. 2 is a block diagram showing main components of the rangefinder 50. A central controller 52 controls the overall operation of the device, including the laser emitter 54, the laser receiver 56 and the distance indicator 40, to be described in more detail below. If the scope 10 includes a mode selection switch (60*a* or 60*b*), then the controller 52 operates in the mode selected by that switch.

As noted above, the rangefinder 50 determines the distance to a sighted target based on one-half of the measured time required for a light beam emitted by laser emitter 54 to travel from the rangefinder 50 to the target and then reflect back to the laser receiver 56, and the speed of light in air, as is well known. The determined distance is then conveyed to the user by distance indicator 40, which typically displays the distance (for example, in yards) on the reticle of the scope 10.

Various structures can be employed as the controller 52. For example, the controller could be an Application Specific Integrated Circuit (ASIC) or a programmed general-purpose processing unit.

As noted previously, existing rangefinders can operate in either a user-specified-measuring mode or in a continuous-measuring mode. The user-specified-measuring mode is a mode in which a measurement to the sighted target is made only when the user issues a command (for example, by pressing a button) to take the measurement. The determined distance then is displayed by the distance indicator 40. The continuous-measuring mode is a mode in which the rangefinder continuously determines the distance to the sighted target, and then continuously displays the determined distance (which could vary continuously as the target moves or as the sighted area of the scope 10 is moved to different targets). As noted above, existing rangefinders only operate in the continuous-measuring mode when a control button is continuously pressed after cycling through the user-specified-measuring mode.

According to one aspect of the invention, the controller 52 controls the rangefinder 50 so that as soon as the rangefinder 50 is activated (turned on), the rangefinder operates in the continuous-measuring mode. Thus, the user will know the distance to target as soon as the target is placed in the sighting area of the scope 10. The user can thus immediately know the distance to target, aim appropriately and fire, without any further manipulation or control of the rangefinder 50. Therefore, the user can fire at the target more quickly than with existing scopes, and the user need not perform any manipulation of the scope and/or rangefinder that might adversely affect the shot by causing movement of the gun. The rangefinder operates in the continuous-measuring mode without the user continuously pressing any button or switch. In one embodiment, the mode selection switch 60*a* or 60*b* is merely an ON/OFF switch, and the controller 52 automatically places the rangefinder into the continuous-measuring mode when the ON/OFF switch is placed into the ON position.

It is envisioned that users still may wish to use the rangefinder in a user-specified-measuring mode in certain circumstances. Thus, according to some aspects of the invention, the rangefinder 50 includes a mode selection switch to alternately switch the mode of operation between the continuously-measuring mode and the user-specified-measuring mode. Such a switch could be provided in addition to an ON/OFF switch.

According to one embodiment, the mode selection switch is a default mode setting switch 60*a* that enables a user to selectively place the rangefinder 50 in either the continuous-measuring mode or in the user-specified-measuring mode as a default mode in which the rangefinder operates when the rangefinder is initially activated (turned on), for example, by a separate ON/OFF switch. Thus, when the rangefinder 50 is equipped with the default mode setting switch 60*a*, the rangefinder could operate like existing rangefinders that are placed in the user-specified-measuring mode when activated, or the rangefinder could operate in the continuous-measuring mode as soon as the rangefinder is activated (turned on).

According to another embodiment, the rangefinder always operates in the continuous-measuring mode as soon as the rangefinder is activated, but after activation the user can actuate a mode-override switch 60*b* to place the rangefinder into the user-specified-measuring mode instead of the continuous-measuring mode.

In the embodiment illustrated in FIG. 1, the default mode setting switch 60*a* and the mode-override switch 60*b* are illustrated as two-position toggle-like switches. However, other types of switches, such as push-button switches, for example, also could be used.

Figure 3:
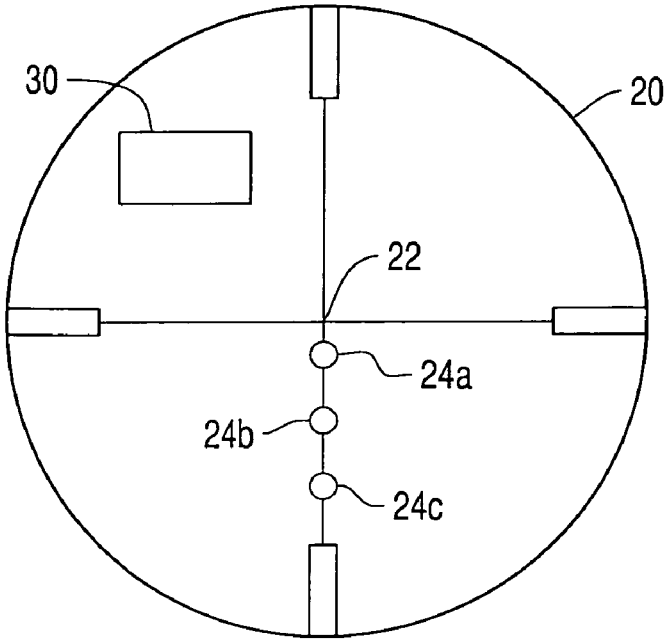
FIG. 3 shows a reticle incorporated into the telescopic gun sight and on which the distance to target is displayed.

FIG. 3 illustrates one type of reticle 20 and display 30 that can be incorporated into the scope 10. The reticle 20 of FIG. 3 includes cross-hairs formed from a centrally-located horizontal line and a centrally-located vertical line. The center point 22, where these two lines intersect is the sighting area used by the rangefinder 50. Thus, the rangefinder 50 determines the distance to the target that corresponds to the center sighting area 22. The rangefinder 50 displays the determined distance to the target in a display area 30. For example, the rangefinder can include an LED display that projects the distance (for example, a number indicating the yards to target) in the display area 30, in a manner well known in the art.

The reticle 20 of FIG. 3 is known as a bullet drop compensation (BDC) reticle that provides additional sighting areas 24*a*, 24*b* and 24*c* located below the center sighting area 22. The additional sighting areas 24*a*-24*c* are used in a manner well known in the art to sight onto the target based upon the distance to the target. As known in the art, a projectile such as a bullet drops vertically as it travels through the air. Thus, the user must aim over the target as the target is located farther away from the gun.

Thus, as is well known in the art, once the user knows the distance to the target, the user uses one of the sighting areas 22, 24*a*, 24*b* or 24*c* to aim at the target depending on the distance. For example, sighting area 22 might be used if the target is located about 200 yards from the gun, whereas sighting areas 24*a*, 24*b* and 24*c* might be used if the target is located 300 yards, 400 yards or 500 yards, respectively, from the gun. Of course, the distances corresponding to the sighting areas depends on the gun and the projectile, and typically is determined by gun users based on experience.

Figure 4:
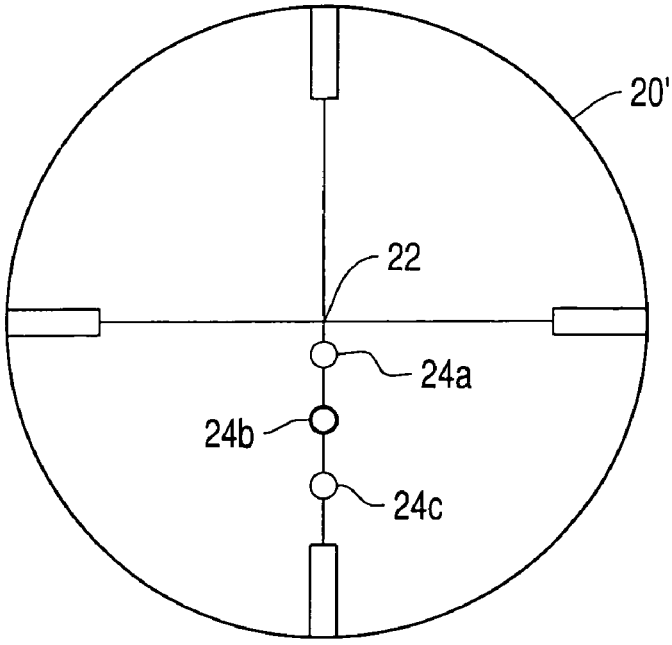
FIG. 4 illustrates a reticle incorporated into another embodiment of a telescopic gun sight in which the distance to the target is indicated to the user by highlighting a sighting area of the gun sight based upon the measured distances to the target.

FIG. 4 illustrates a different reticle 20' that is similar to the FIG. 3 reticle 20 except for the manner in which the distance-to-target is conveyed to the user. Instead of indicating the distance-to-target by displaying the yardage in a display, the FIG. 4 embodiment highlights the appropriate sighting area based on the determined distance. In FIG. 4, sighting area 24*b* is highlighted by being displayed darker than the other sighting areas. The hairlines and sighting areas in the FIG. 4 embodiment are displayed by projection onto the reticle, rather than being physical indicia such as etched lines and circles. Thus, the highlighting of the appropriate sighting area is accomplished by changing the image that is displayed.

Although the illustrated embodiments use a laser rangefinder, other types of rangefinders, such as rangefinders using radio waves, electromagnetic waves, sonic waves or ultrasonic waves, for example, also can be used with the invention.

While the invention has been described with reference to preferred embodiments thereof, it is to be understood that the invention is not limited to these embodiments or constructions. The invention is intended to cover various modifications and arrangements. While the various elements of the exemplary embodiments are shown in various combinations and configurations, other combinations and configurations, including more, less or only a single element, also are within the spirit and scope of the invention.

What is claimed is:

1. A gun sight comprising:

a reticle through which a target is viewed; and a rangefinder including a transmitter and a receiver, the transmitter emitting energy toward the target, the receiver receiving energy reflected by the target, the rangefinder determining a distance to the target from the energy received by the receiver, the rangefinder including a switch that places the rangefinder in a continuous-measuring mode, the rangefinder continuously determining the distance to the target when in the continuous-measuring mode, the rangefinder remaining in the continuous-measuring mode without requiring a user to continuously press the switch.

2. The gun sight of claim 1, wherein the rangefinder includes a default mode setting switch that enables a user to selectively place the rangefinder in either the continuous-measuring mode or a user-specified-measuring mode as a default mode in which the rangefinder initially operates when the rangefinder is turned on.

3. The gun sight of claim 1, wherein the rangefinder includes a mode-override switch that enables a user to place the rangefinder into a user-specified-measuring mode instead of the continuous-measuring mode.

4. The gun sight of claim 1, wherein the rangefinder includes a display that displays the measured distance to the target for viewing by a user of the gun sight.

5. The gun sight of claim 4, wherein the display displays the measured distance on the reticle.

6. The gun sight of claim 1, wherein the rangefinder indicates the measured distance to the target.

7. The gun sight of claim 6, wherein the rangefinder indicates the measured distance to the target by identifying a sighting area of the reticle that should be used to aim at the target.

8. The gun sight of claim 6, wherein the rangefinder indicates the measured distance to the target by highlighting a sighting area of the reticle based on the measured distance.

9. The gun sight of claim 1, wherein the switch is an ON/OFF switch having an ON position and an OFF position, and the rangefinder is placed in the continuous-measuring mode by placing the switch in the ON position.

10. The gun sight of claim 1, wherein the gun sight is a telescopic gun sight having a variable magnification.

11. The gun sight of claim 1, wherein the rangefinder is a laser rangefinder, the transmitter is a laser transmitter and the receiver is a laser receiver.

12. A telescopic gun sight comprising:

a reticle through which a target is viewed; and a laser rangefinder including a laser transmitter and a laser receiver, the laser transmitter emitting a laser beam toward the target, the laser receiver receiving light reflected by the target, the laser rangefinder determining a distance to the target from the reflected light received by the laser receiver, the laser rangefinder including a switch that places the laser rangefinder in a continuous-measuring mode, the laser rangefinder continuously determining the distance to the target when in the continuous-measuring mode, the laser rangefinder remaining in the continuous-measuring mode without requiring a user to continuously press the switch.

13. The telescopic gun sight of claim 12, wherein the laser rangefinder includes a default mode setting switch that enables a user to selectively place the laser rangefinder in either the continuous-measuring mode or a user-specified-measuring mode as a default mode in which the laser rangefinder initially operates when turned on.

14. The telescopic gun sight of claim 12, wherein the laser rangefinder includes a mode-override switch that enables a user to place the laser rangefinder into a user-specified-measuring mode instead of the continuous-measuring mode.

15. The telescopic gun sight of claim 12, wherein the laser rangefinder includes a display that displays the measured distance to the target for viewing by a user of the telescopic gun sight.

16. The telescopic gun sight of claim 15, wherein the display displays the measured distance on the reticle.

17. The telescopic gun sight of claim 12, wherein the laser rangefinder indicates the measured distance to the target.

18. The telescopic gun sight of claim 17, wherein the laser rangefinder indicates the measured distance to the target by identifying a sighting area of the reticle that should be used to aim at the target.

19. The telescopic gun sight of claim 17, wherein the rangefinder indicates the measured distance to the target by highlighting a sighting area of the reticle based on the measured distance.

20. The telescopic gun sight of claim 12, wherein the switch is an ON/OFF switch having an ON position and an OFF position, and the rangefinder is placed in the continuous-measuring mode by placing the switch in the ON position.

* * * * *